US010085316B2

(12) United States Patent
Colin et al.

(10) Patent No.: US 10,085,316 B2
(45) Date of Patent: Sep. 25, 2018

(54) CIRCUIT FOR LED DRIVER

(71) Applicant: PHILIPS LIGHTING HOLDING B.V., Eindhoven (NL)

(72) Inventors: Bai Colin, Eindhoven (NL); Yefei Zhou, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/264,323

(22) Filed: Sep. 13, 2016

(65) Prior Publication Data

US 2017/0079105 A1 Mar. 16, 2017

Related U.S. Application Data

(60) Provisional application No. 62/219,406, filed on Sep. 16, 2015.

(51) Int. Cl.
*H05B 37/02* (2006.01)
*H05B 33/08* (2006.01)

(52) U.S. Cl.
CPC ..... *H05B 33/0842* (2013.01); *H05B 33/0809* (2013.01); *H05B 33/0884* (2013.01)

(58) Field of Classification Search
CPC .. H01F 30/04; H05B 33/0809; H05B 33/0842
USPC ... 315/277, 266, 57, 70, 141, 177, 206, 220, 315/255
See application file for complete search history.

(56) References Cited

U.S. PATENT DOCUMENTS 6,326,740 B1 12/2001 Chang et al.
7,446,512 B2 * 11/2008 Nishihara ..... H02M 3/3376 323/233
9,018,852 B2 * 4/2015 Jin ..... H05B 33/0815 315/277
2001/0007410 A1 7/2001 Koch et al.
2005/0093471 A1 * 5/2005 Jin ..... H01F 38/00 315/177
2005/0225261 A1 10/2005 Jin
2007/0007908 A1 * 1/2007 Kim ..... H05B 41/2827 315/282
2007/0247082 A1 10/2007 Ashikaga et al.
2009/0154043 A1 * 6/2009 Kim ..... H05B 41/282 361/88
2009/0195173 A1 * 8/2009 Morimoto ..... H01F 38/10 315/277

(Continued)

*Primary Examiner* — Douglas W Owens
*Assistant Examiner* — Henry Luong
(74) *Attorney, Agent, or Firm* — Akarsh P. Belagodu

(57) ABSTRACT

A circuit for a LED driver adjusts current output depending on whether one or more lamps are connected to the driver. The circuit includes a transformer with a first primary winding having a first winding direction and configured to receive current in a first direction when coupled to a first load. The first primary winding is positioned to induce current in a secondary winding in a second direction. The circuit also includes a second primary winding having a second winding direction and configured to receive current in a third direction when coupled to a second load. The second primary winding is positioned to induce current in the secondary winding in a fourth direction. The second and fourth directions are opposed such that the induced currents will cancel to the extent that a magnitude of each induced current is equal.

15 Claims, 7 Drawing Sheets

(56) References Cited

U.S. PATENT DOCUMENTS

2015/0091463 A1* 4/2015 Jin ..... H05B 33/0809
315/201

* cited by examiner

CIRCUIT FOR LED DRIVER

FIELD OF THE INVENTION

The present disclosure is directed generally to an inventive circuit for a LED driver that adjusts current output depending on whether one or more lamps are connected to the driver.

BACKGROUND

Fluorescent lamps have found widespread use in settings such as office buildings, hospitals, grocery stores, display cases, etc. However, many fluorescent lamps are being replaced by TLED (tubular light emitting diode) lamps. TLED lamps are brighter, more efficient, and longer-lasting than their predecessors. Many of these TLED lamps are designed to seamlessly fit into existing linear fluorescent fixtures—offering a simple and cost-effective way to retrofit existing fluorescent fixtures with the newer TLEDs.

SUMMARY OF THE INVENTION

TLED lamps may be powered by an LED driver which is designed to supply the proper amount of power to operate the TLEDs. Many TLED drivers are configured to supply power for two or more TLED lamps. However, if one lamp is disconnected from an LED driver that is designed to operate two lamps, the remaining connected lamp may receive too much power. This can cause the remaining lamp to burn brighter than designed, and can shorten the lifespan of the lamp.

Accordingly, there exists a need in the art for a way to automatically adjust when a lamp has been disconnected from an LED driver so that the power delivered to the remaining lamp may be adjusted appropriately.

The present disclosure is directed to an inventive circuit for an LED driver that adjusts current output depending on whether one or more lamps are connected to the driver. Various embodiments and implementations herein are directed to a load detection circuit that includes a transformer having two primary windings and a single secondary winding. Each primary winding is configured to only receive current when a lamp is attached to a particular terminal. Further, each primary winding is configured to induce a current in the secondary winding in a direction opposite the current produced by the other primary winding. In this way, when both lamps are attached and both primary windings are receiving current, the currents induced in the secondary winding will cancel. But when only one lamp is attached, only one primary winding conduct current and the induced current in the secondary winding will not cancel. Thus, if the secondary is not conducting current, both lamps are attached, but if secondary winding is conductive current, then only one lamp is attached.

Generally in one aspect, a circuit for operating with one or more loads is provided. The circuit includes: a transformer, including: a secondary winding, a first primary winding having a first winding direction and configured to receive current in a first direction when coupled to a first load, wherein the first primary winding is positioned to induce current in the secondary winding in a second direction when current is flowing through the first primary winding in the first direction; and a second primary winding having a second winding direction and configured to receive current in a third direction when coupled to a second load, wherein the second primary winding is positioned to induce current in the secondary winding in a fourth direction when current is flowing through the first primary winding in the third direction; wherein the second and fourth directions are opposed such that the induced currents will cancel to the extent that a magnitude of each induced current is equal.

According to an embodiment, the circuit includes: a diode bridge coupled to the secondary winding and configured to produce the same polarity output for either polarity of current in the secondary winding.

According to an embodiment, the first winding direction and the second winding directions are the same and the first direction and the third direction are opposed.

According to an embodiment, the first winding direction and the second winding direction are opposed and the first direction and the third direction are same.

According to an embodiment, the first and second loads are lamps.

According to an embodiment, the circuit includes a controller coupled to the secondary winding and configured to adjust a current supplied to the first load or a current supplied to the second load according to the current in the secondary winding.

According to an embodiment, the circuit includes a power-supply configured to supply the current to the first load and the current to the second load.

According to an embodiment, the circuit includes a diode coupled in a series relationship with the secondary winding.

According to an embodiment, the circuit includes a resistor coupled in a parallel relationship with the secondary winding.

According to an aspect, an LED driver configured to operate with one or more loads, comprising: a transformer, includes a secondary winding, a first primary winding having a first winding direction and configured to receive current in a first direction when coupled to a first load, wherein the first primary winding is positioned to induce current in the secondary winding in a second direction when current is flowing through the first primary winding in the first direction; a second primary winding having a second winding direction and configured to receive current in a third direction when coupled to a second load, wherein the second primary winding is positioned to induce current in the secondary winding in a fourth direction when current is flowing through the first primary winding in the third direction; wherein the second and fourth directions are opposed such that the induced currents will cancel to the extent that a magnitude of each induced current is equal; a controller coupled to the secondary winding and configured to adjust a current supplied to the first load or a current supplied to the second load according to the current in the secondary winding; and a power-supply configured to supply the current to the first load and the current to the second load.

According to an embodiment, the circuit includes a diode bridge coupled to the secondary winding and configured to produce the same polarity output for either polarity of current in the secondary winding.

According to an embodiment, the first winding direction and the second winding directions are the same and the first direction and the third direction are opposed.

According to an embodiment, the first winding direction and the second winding direction are opposed and the first direction and the third direction are same.

According to an embodiment, wherein the first and second loads are lamps.

According to an embodiment, the lamps are tubular LEDs.

As used herein for purposes of the present disclosure, the term "controller" is used generally to describe various apparatus relating to the operation of an LED driver apparatus, system, or method. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

These and other aspects of the invention will be apparent from and elucidated with reference to the embodiment(s) described hereinafter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION OF EMBODIMENTS

The present disclosure describes various embodiments of an LED driver load detection circuit. More generally, Applicants have recognized and appreciated that it would be beneficial to provide a circuit that can detect whether one or more lamps are connected to an LED driver circuit. The circuit described herein provides for an LED driver that adjusts current output depending on whether one or more lamps are connected to the driver. For example, the load detection circuit may comprise a transformer, the secondary winding of which only conducts current when a single lamp is connected to an LED driver configured to supply current to two lamps. The transformer uses two primary windings that are configured to produce opposing magnetic fields when receiving current. Current only flows through each winding when a lamp is connected to a particular terminal.

In view of the foregoing, various embodiments and implementations are directed to a circuit that detects whether one or more lamps are connected to a LED driver. When LED drivers are configured to supply current to two lamps, for example, if one lamp is disconnected, the remaining connected lamp is supplied with too much current. In accordance with the present application, the inventive circuit detects when one lamp has been removed, so that the current supplied to the remaining lamp (i.e. the LED driver output) may be diminished accordingly. Furthermore, it is possible to detect whether one or more lamps are connected using a circuit that is isolated from the circuit that is supplying power to the lamps.

In certain embodiments, the circuit primarily consists of a transformer that has two primary windings and one secondary winding. Each of the primary windings may be connected to one of the lamps. The primary windings may be configured to produce opposing magnetic fields when current is flowing through them. Thus, when two lamps are connected and current is flowing through both primary windings, the currents induced in the secondary winding by the magnetic fields cancel, and the net current flow in the secondary winding is approximately zero. When only one lamp is connected and current is flowing through only one primary winding, the current induced in the secondary winding by the magnetic field is not canceled, and, consequently, current flows through the secondary winding. This way, the presence of one or two lamps may be determined by monitoring the current flowing through the secondary winding.

Figure 1A:
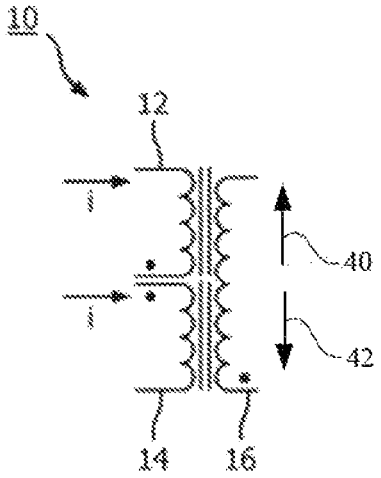
FIG. 1A is a schematic of a circuit in accordance with an embodiment.

FIG. 1A shows a load detection circuit 10 according to an embodiment. As shown, detection circuit 10 comprises a transformer including a first primary winding 12, a second primary winding 14, and a secondary winding 16. First primary winding 12 and second primary winding 14 are each positioned to induce current in the secondary winding 16. More particularly, first primary winding 12 is configured to induce current in secondary winding 16 in a direction 40 opposing a direction 42 of the current induced by second primary winding 14. Thus, when current is flowing through first primary winding 12 and second primary winding 14 simultaneously, the currents induced in the secondary winding 16 will cancel to the extent that the magnitudes of the induced currents are substantially the same. However, when current is flowing through each of first primary winding 12 and second primary winding 14 individually, current will flow through secondary winding 16 without any canceling.

Referring again to FIG. 1A, the magnetic fields of first primary winding 12 and second primary 14, in an exemplary embodiment, oppose one another because primary windings 12, 14 are wound in opposite directions, but are configured to receive current at the same terminal (e.g. both receive current at the top terminal). Because first primary winding 12 and second primary winding 14 are wound in opposite directions, and current is flowing in the same direction in each, each produces a magnetic field that opposes the other.

The magnetic fields of each primary winding 12, 14, acting upon secondary winding 16, will cancel to the extent that the induced currents are equal.

Figure 1B:
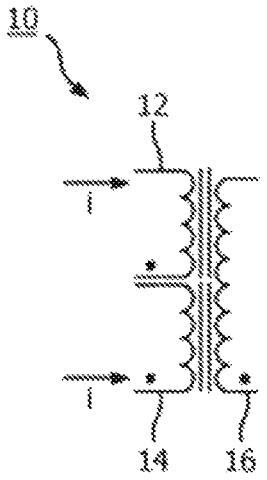
FIG. 1B is a schematic of a circuit in accordance with an embodiment.

Alternately, as shown in FIG. 1B, first primary winding 12 and second primary winding 14 may be wound in the same direction, but receive current at different terminals (e.g. as shown, current may flow into the top terminal of first primary winding 12, but the bottom terminal of second primary winding 14). Because each primary winding 12, 14 is wound in the same direction, but current is flowing in opposite directions, each will produce a magnetic field that opposes the other. One of ordinary skill in the art will recognize that FIGS. 1A and 1B are symbolic representations of primary windings 12, 14, 16, and are simply representative of the inductive relationship between windings 12, 14, 16, the respective winding directions of the windings 12, 14, 16, and the directions of the currents flowing in windings 12, 14, 16. Accordingly, the exact spatial placement and orientation of windings 12, 14, 16, may vary so long as the relative directions of current flow and windings remain the same. One of ordinary skill in the art will also appreciate that the secondary winding may be wound in any desired direction for either of the embodiments depicted in FIGS. 1A and 1B.

Figure 2:
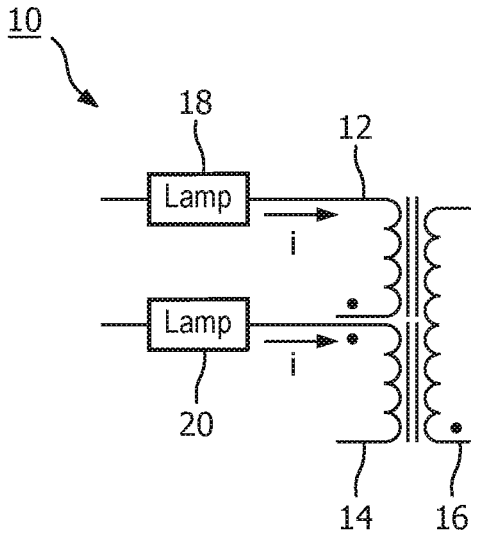
FIG. 2 is a schematic of a circuit in accordance with an embodiment.

As shown in FIG. 2, and in an exemplary embodiment, first primary winding 12 only receives current via a load 18 and second primary winding 14 only receives current via a load 20. Thus when load 18 is attached, current flows through first primary winding 12, and when load 20 is attached, current flows through second primary winding 14. In this way, current will only be induced in secondary winding 16 when only one of loads 18, 20 is attached. Thus, the presence of current in secondary winding 16 indicates that only one load is attached to current detection circuit 10. In an exemplary embodiment, loads 18, 20 are lamps, such as the PHILIPS INSTANTFIT T8 Lamp. However, any other lamp or load, such as an electric motor, may be used.

Figure 3A:
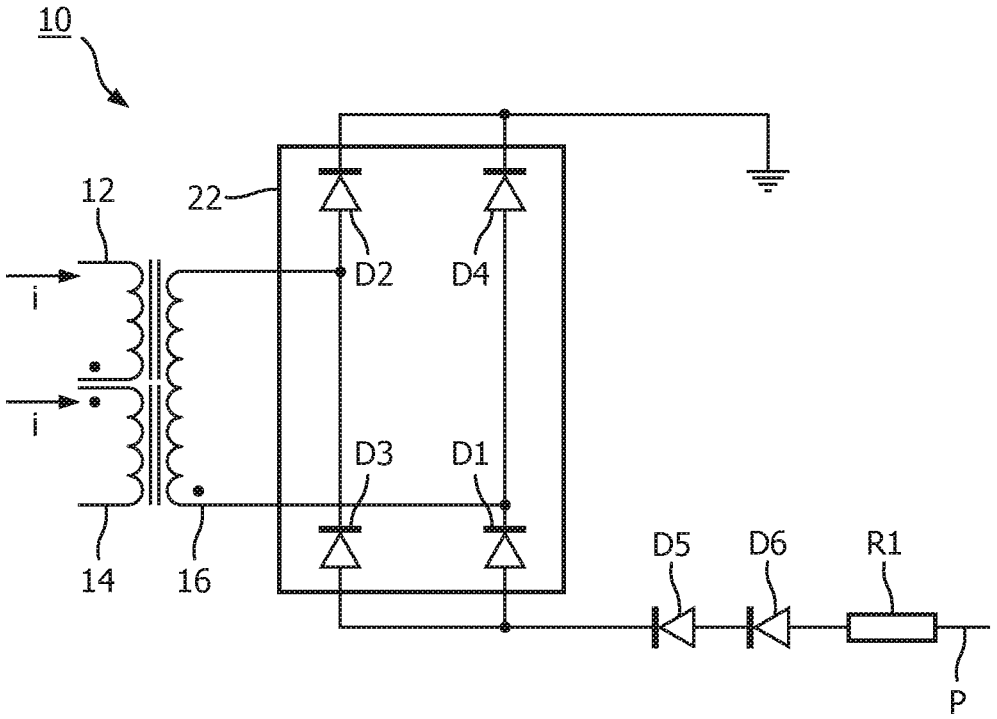
FIG. 3A is a schematic of a circuit in accordance with an embodiment.

As shown in FIG. 3A, load detection circuit 10 may further comprise a diode bridge 22 coupled to secondary winding 16. Diode bridge 22 produces the same polarity output for either polarity of current in second winding 16. Thus, when current is induced in secondary winding 16 by first primary winding 12, the current output by diode bridge 22 will flow in the same direction as when current is induced in secondary winding 16 by second primary winding 14. In a preferred embodiment, diode bridge 22 is comprised of four diodes: D1, D2, D3, and D4. When current is flowing upward (with respect to the page) through secondary winding 16, diodes D1 and D2 will conduct and current will be drawn from feedback pin P to ground. However, when current is flowing through secondary winding 16 in the downward direction, diodes D3 and D4 will conduct, and current will be drawn from feedback pin P in the same direction as when diodes D1 and D2 were conducting. Thus, the current drawn through secondary winding 16 may be monitored by any circuit or device attached to feedback pin P. In this way, feedback pin P represents the output of load detection circuit 10.

Furthermore, load detection circuit 10 may comprise at least one threshold diode. Because there will likely be some disparity between the magnitudes of the currents supplied through loads 18, 20, there may be some current induced in secondary winding 16 even when both primary windings 12, 14 are conducting. Accordingly, it is useful to attach at least one diode in the current path of secondary winding 16 (i.e. in a series relationship with secondary winding 16) to prevent the conduction of current until the threshold voltages of each diode is reached. In the embodiment shown in FIG. 3A, the threshold voltage of diodes D5, D6 may be approximated to be 0.75 volts. Thus, the voltage drop across the diodes D5, D6 must reach 3.5 volts before current will begin to flow through secondary winding 16. In this way, load detection circuit may be designed to allow current tolerances in primary windings 12, 14. Although two threshold diodes D5, D6 are shown in FIG. 3A, one of ordinary skill will appreciate that any number may be used according to the particular needs of load detection circuit 10. Load detection circuit 10 may also employ a current limiting resistor R1 which may be sized to control the current drawn from feedback pin P.

Figure 3B:
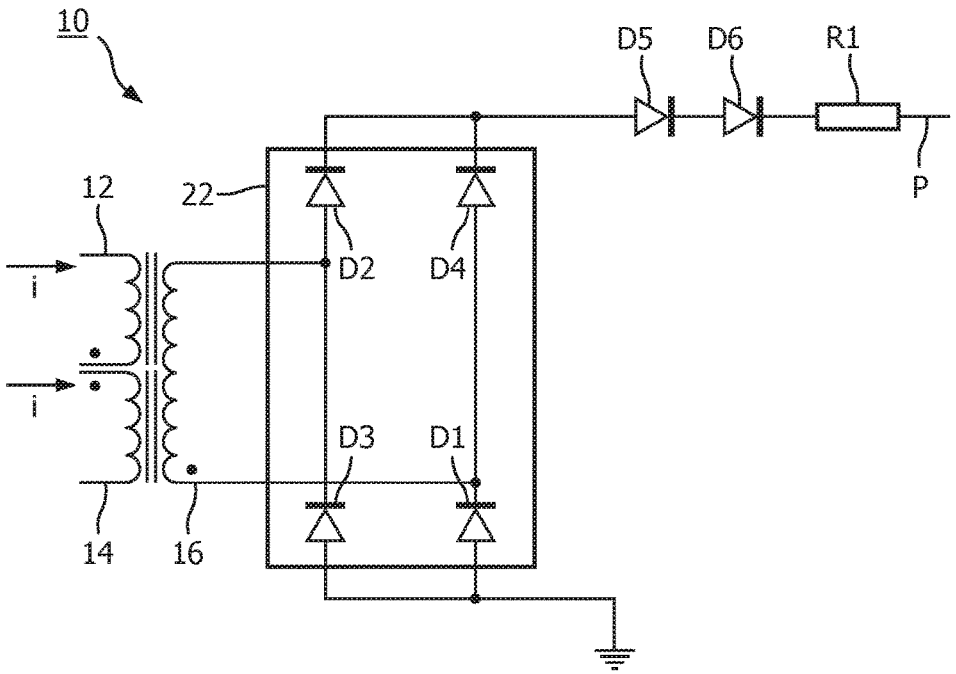
FIG. 3B is a schematic of a circuit in accordance with an embodiment.

FIG. 3B depicts an alternate configuration of load detection circuit 10. In this embodiment, threshold diodes D5, D6, current limiting resistor R1, and feedback pin P may be placed at the output of diode bridge 22. Thus, current will flow out of feedback pin P when current is flowing through secondary winding 16. One of ordinary skill will appreciate that any number of configurations of load detection circuit 10 may be implemented, in keeping with the scope of this disclosure, as long as the relationships (i.e. series and parallel) and functions of the elements are maintained.

Figure 4:
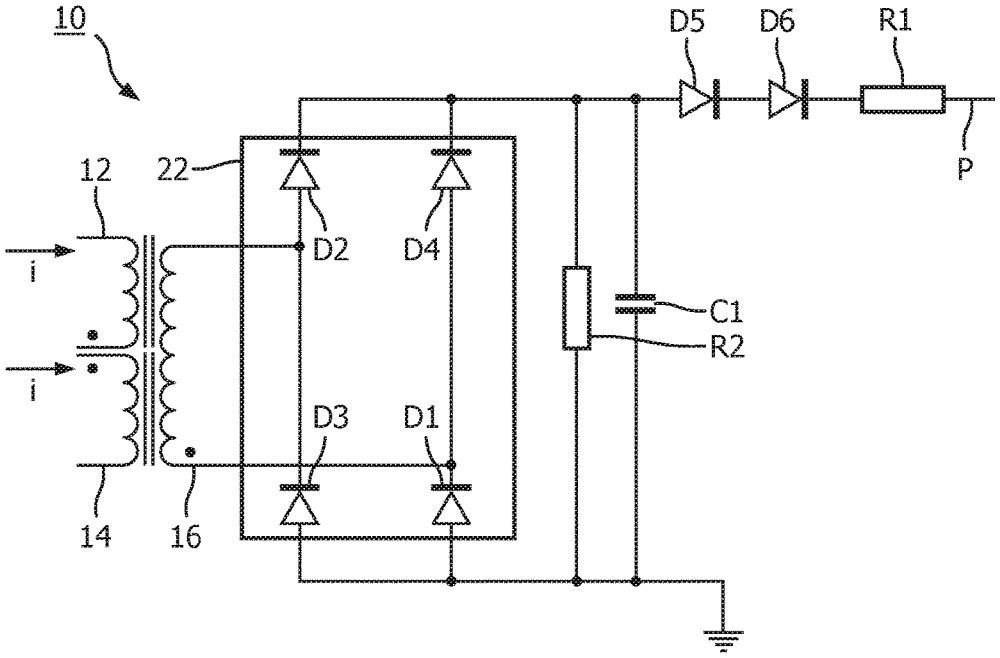
FIG. 4 is a schematic of a circuit in accordance with an embodiment.

As shown in FIG. 4, load detection circuit 10 may further comprise, in one embodiment, resistor R2 and a capacitor C1 in a parallel relationship with secondary winding 16. R2 and C1 are configured to convert the secondary winding 16 into a voltage source. Because the current through resistor R2 will be equivalent to the current flowing through primary winding 16, the voltage across resistor will be proportional to the current flowing through secondary winding 16. Thus, the voltage across resistor R2 will be present at feedback pin P when current is flowing through secondary winding 16. This effectively transforms secondary winding 16 into a voltage source, rather than a current source, during operation. One of ordinary skill in the art will appreciate that some applications of load detection circuit 10 may require a voltage output that is proportional to the current flowing through secondary winding 16, instead of simply a current output. Furthermore, capacitor C1 may be employed as a smoothing capacitor to regulate the voltage of feedback pin P.

Figure 5:
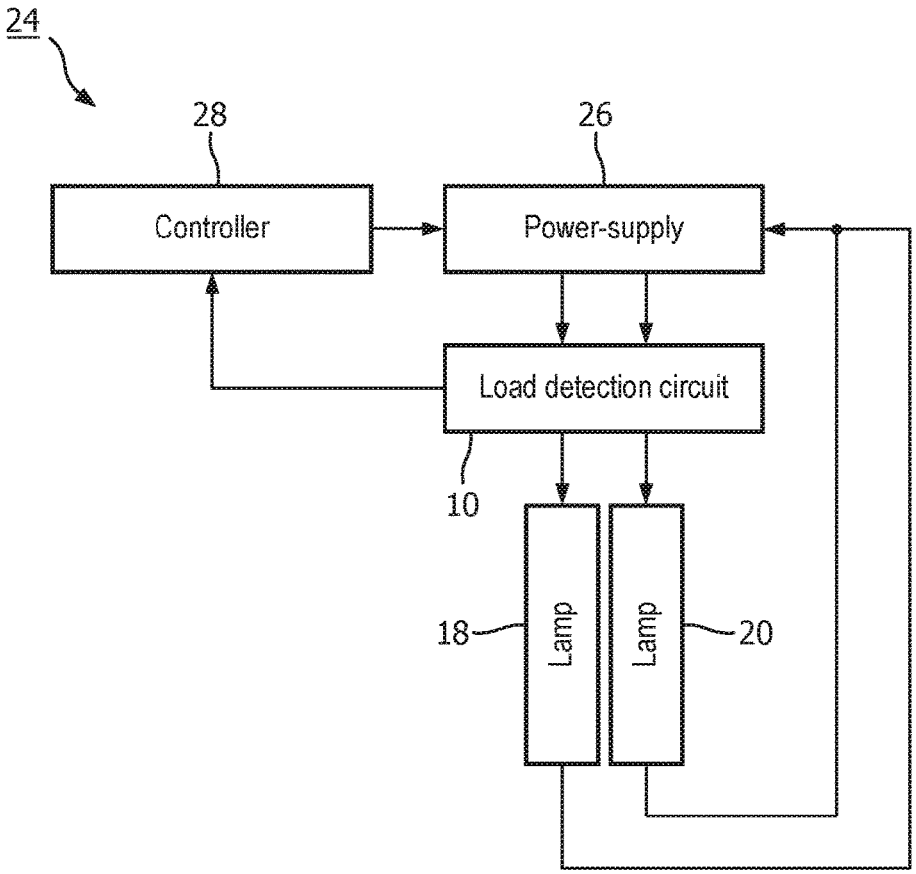
FIG. 5 is a schematic of an LED driver in accordance with an embodiment.

As shown in FIG. 5, load detection circuit 10 may be part of a larger LED driver 24. LED driver 24 may comprise a controller 28 coupled to power-supply 26. Power supply circuit 26 is configured to supply power to LED lamps 18, 20. The amount of power delivered to each LED lamp 18, 20 is determined by controller 28. Controller 28 is, in turn, coupled to, and configured to detect when, secondary winding 16 is conducting. For example, controller may be connected to feedback pin P to detect the presence of a voltage or current at feedback pin P. Thus, when secondary winding 16 is conducting, controller 28 may be configured to modify the current supplied to one or both of lamps 18, 20 by adjusting the output power of power-supply 26.

For example, if only lamp 18 is attached, first primary winding 12 will receive current and will induce current in secondary winding 16. This current may then be detected by controller 28 which may then configure power-supply 26 to reduce the current delivered to lamp 18, since only one lamp is being powered. Alternatively, controller 28 may configure power-supply 26 to increase the current delivered to lamp 18. Similarly, once lamp 20 is attached, secondary winding 16 will cease to conduct current, and controller 28 may configure power-supply 26 to deliver the same current to each lamp 18 and 20. One of ordinary skill in the art will recognize that controller 28 may be designed to set power-supply 26 deliver any amount of current to loads 18, 20 for any number of configurations.

Figure 6:
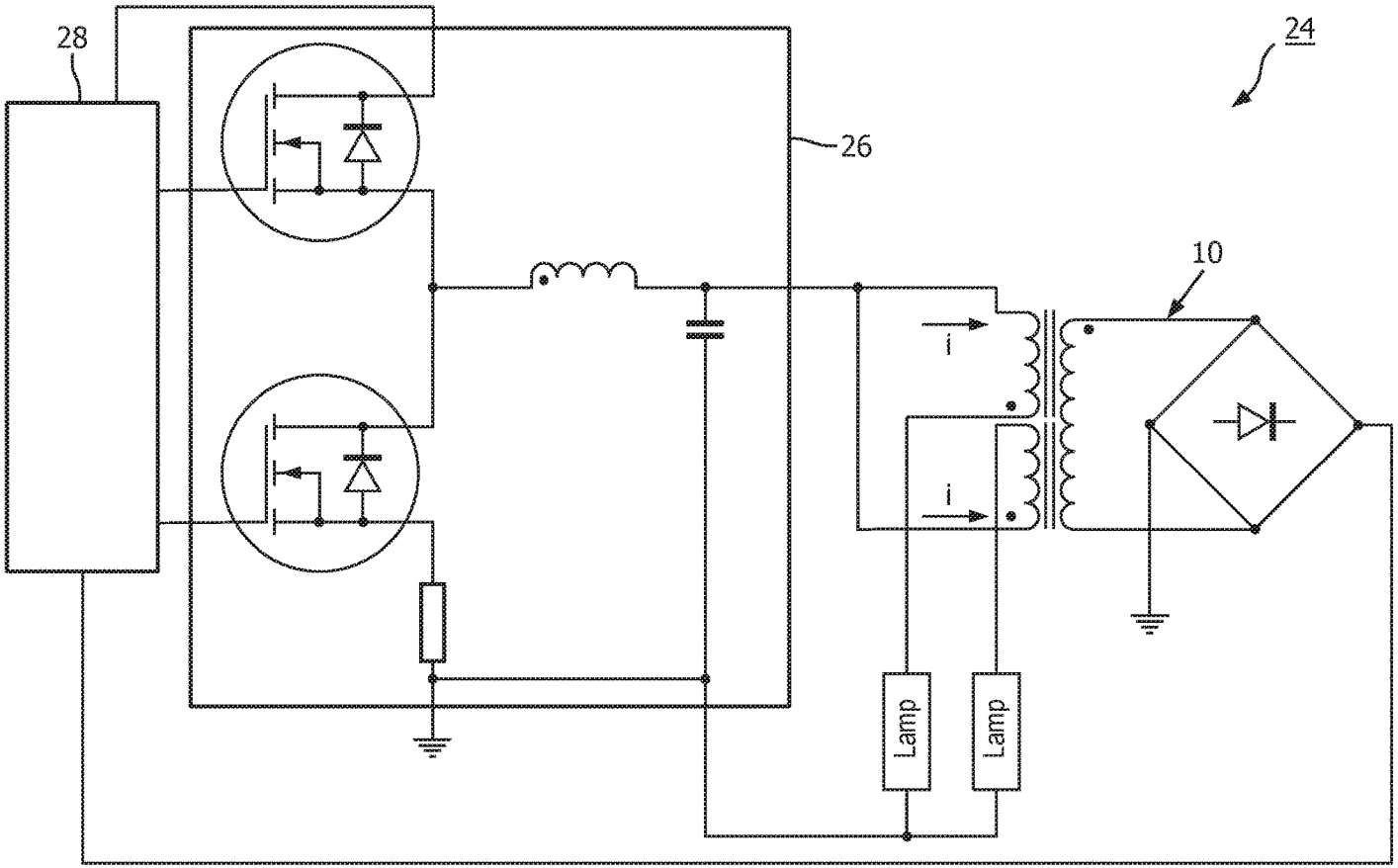
FIG. 6 is a schematic of an LED driver in accordance with an embodiment.
Figure 7:
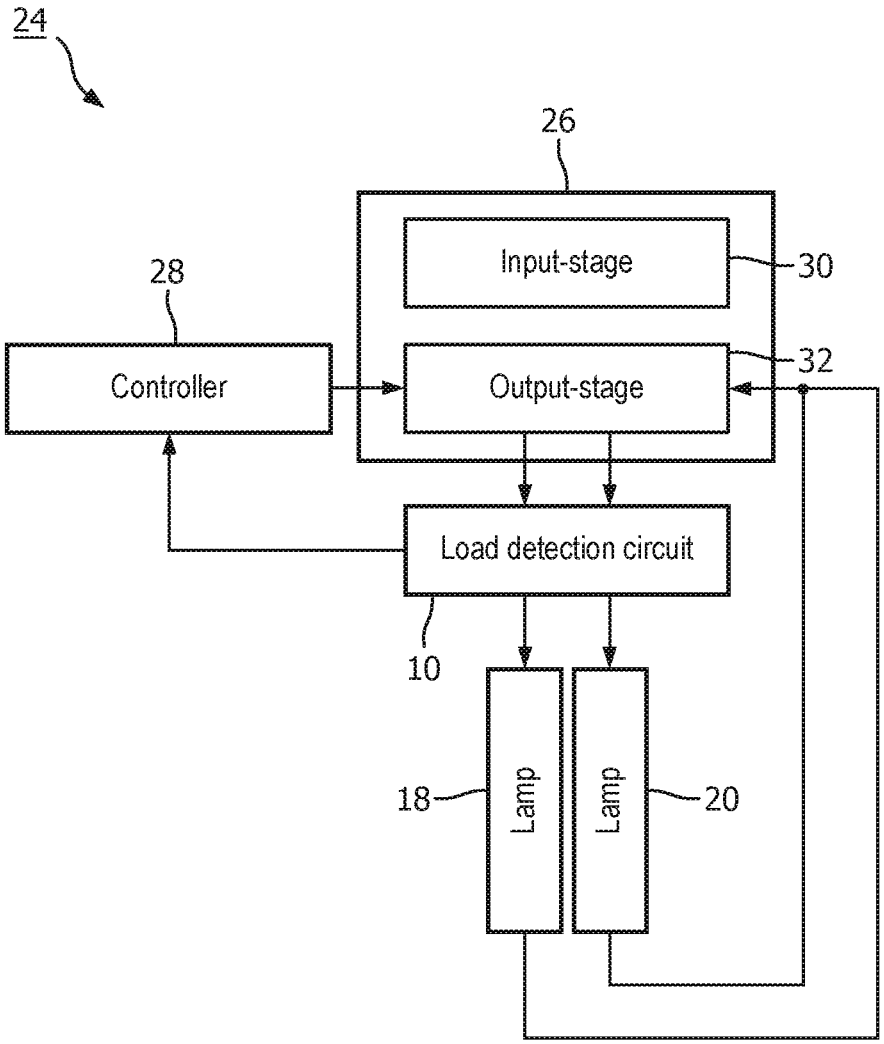
FIG. 7 is a schematic of an LED driver in accordance with an embodiment.

Furthermore, as depicted in FIG. 6, in an exemplary embodiment, power-supply 26 may be a half-bridge power supply, as are known in the art. However, power-supply 26 may be any power-supply suitable for powering loads 18, 20. FIG. 7 shows a generic power-supply 26, having an input-stage 30 and an output-stage 32. Input-stage 30 may, for example, be a rectifying stage to convert input power to DC. Output stage 32 may amplify or otherwise configure the DC power signal for loads 18, 20.

Figure 8A:
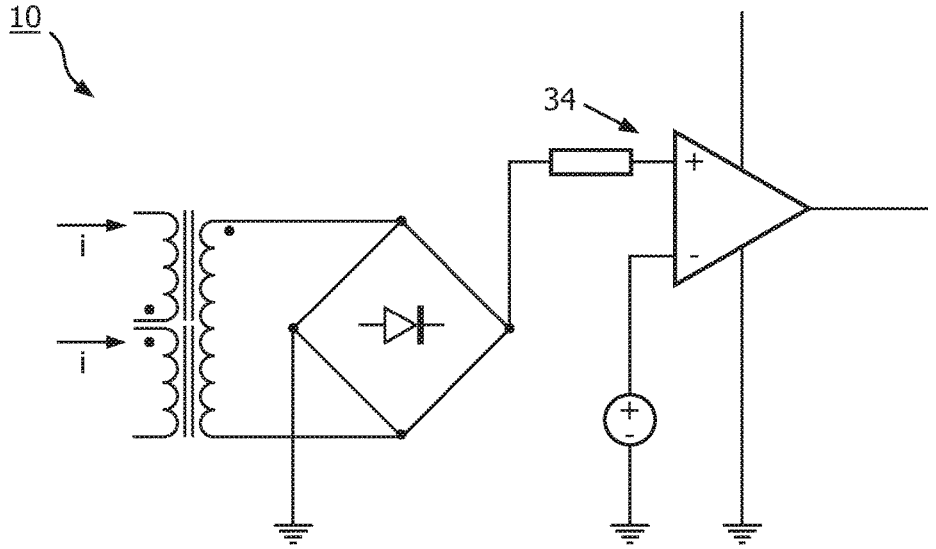
FIG. 8A is a schematic of a circuit and an amplifier in accordance with an embodiment.
Figure 8B:
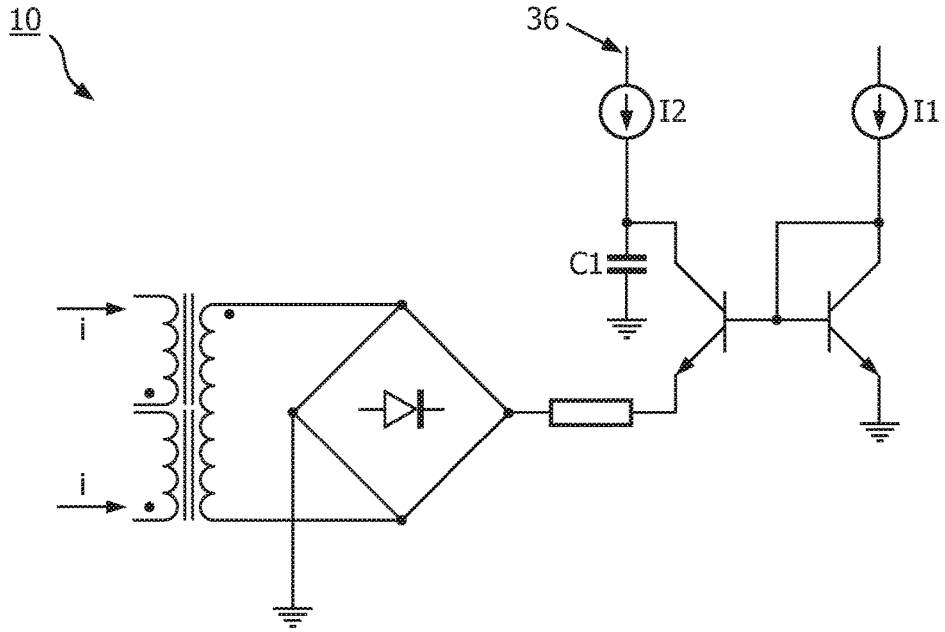
FIG. 8B is a schematic of a circuit and a current mirror in accordance with an embodiment.

In alternate embodiments, load detection circuit 10 may instead be attached to any IC control pins or external circuits, such as an amplifier or current mirror. FIGS. 8A-8B show general applications for load detection circuit 10 as it may be attached to a current mirror 36 or amplifier 34.

Although the methods and systems described herein are applied to LED driver devices, it is anticipated that the methods and systems could similarly be utilized for other devices, including but not limited to any device supplying power to more than one detachable loads.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of"

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

What is claimed is:

1. A load detection circuit for operating with one or more loads, comprising:

a single transformer, comprising:

a secondary winding, a first primary winding having a first winding direction and configured to receive current in a first direction when coupled to a first load, wherein the first primary winding is positioned to induce current in the secondary winding in a second direction when current is flowing through the first primary winding in the first direction, and a second primary winding having a second winding direction and configured to receive current in a third direction when coupled to a second load, wherein the second primary winding is positioned to induce current in the secondary winding in a fourth direction when current is flowing through the second primary winding in the third direction; and a diode bridge coupled to the secondary winding and configured to produce the same polarity output for either polarity of current in the secondary winding, wherein the second and fourth directions are opposed such that the induced currents cancel to the extent that a magnitude of each induced current is equal.

2. The load detection circuit of claim 1, wherein the load detection circuit is configured to detect when the secondary winding is conducting.

3. The load detection circuit of claim 2, wherein the first winding direction and the second winding directions are the same and the first direction and the third direction are opposed.

4. The load detection circuit of claim 2, wherein the first winding direction and the second winding direction are opposed and the first direction and the third direction are same.

5. The load detection circuit of claim 1, wherein the first and second loads are lamps.

6. The load detection circuit of claim 1, further comprising a controller coupled to the secondary winding and configured to adjust a current supplied to the first load or a current supplied to the second load according to the current in the secondary winding.

7. The load detection circuit of claim 6, further comprising a power-supply configured to supply the current to the first load and the current to the second load.

8. The load detection circuit of claim 1, further comprising a diode coupled in a series relationship with the secondary winding.

9. The load detection circuit of claim 1, further comprising a resistor coupled in a parallel relationship with the secondary winding.

10. An LED driver configured to operate with one or more loads, comprising:

a single transformer, comprising:

a secondary winding, a first primary winding having a first winding direction and configured to receive current in a first direction when coupled to a first load, wherein the first primary winding is positioned to induce current in the secondary winding in a second direction when current is flowing through the first primary winding in the first direction, and a second primary winding having a second winding direction and configured to receive current in a third direction when coupled to a second load, wherein the second primary winding is positioned to induce current in the secondary winding in a fourth direction when current is flowing through the second primary winding in the third direction, wherein the second and fourth directions are opposed such that the induced currents will cancel to the extent that a magnitude of each induced current is equal; and a controller coupled to the secondary winding and configured to adjust a current supplied to the first load or a current supplied to the second load according to the current in the secondary winding;

a power-supply configured to supply the current to the first load and the current to the second load; and a diode bridge coupled to the secondary winding and configured to produce the same polarity output for either polarity of current in the secondary winding.

11. The LED driver of claim 10, wherein the controller is configured to detect when the secondary winding is conducting.

12. The LED driver of claim 10, wherein the first winding direction and the second winding directions are the same and the first direction and the third direction are opposed.

13. The LED driver of claim 10, wherein the first winding direction and the second winding direction are opposed and the first direction and the third direction are same.

14. The LED driver of claim 10, wherein the first and second loads are lamps.

15. The LED driver of claim 14, wherein the lamps are tubular LEDs.

* * * * *